United States Patent [19]

Maryyanek et al.

[11] Patent Number: 4,592,350

[45] Date of Patent: Jun. 3, 1986

[54] RESPIRATOR

[75] Inventors: Richard D. Maryyanek, Northbridge; Joseph Z. Zdrok, Webster, both of Mass.

[73] Assignee: American Optical Corporation, Southbridge, Mass.

[21] Appl. No.: 700,323

[22] Filed: Feb. 11, 1985

Related U.S. Application Data

[63] Continuation of Ser. No. 493,664, May 11, 1983, abandoned, which is a continuation-in-part of Ser. No. 439,930, Nov. 8, 1982, abandoned.

[51] Int. Cl.[4] ..... A62B 7/00

[52] U.S. Cl. ..... 128/206.17

[58] Field of Search ..... 128/205.27, 205.29, 128/206.12, 206.15, 206.17, 201.25

[56] References Cited

U.S. PATENT DOCUMENTS

| | | | |
|---|---|---|---|
| 2,114,358 | 4/1938 | Schwartz | 128/206.15 |
| 2,206,061 | 7/1940 | Splaine | 128/206.15 |
| 2,295,119 | 9/1942 | Malcom et al. | 128/206.17 |
| 2,505,173 | 4/1950 | Conley | 128/141 |
| 2,640,481 | 6/1953 | Conley | 128/146 |
| 2,744,524 | 5/1956 | Whipple | 128/146 |
| 2,791,216 | 5/1957 | Churchill et al. | 128/206.17 |
| 3,307,543 | 3/1967 | Silverman | 128/206.17 |
| 4,179,274 | 12/1979 | Moon | 128/206.17 |
| 4,414,973 | 11/1983 | Matheson et al. | 128/206.17 |
| 4,501,272 | 2/1985 | Shigematsu et al. | 128/206.17 |

OTHER PUBLICATIONS

Wilson, "Respirator Protects Against Fumes of Metals", American Machinists Mag. 7/12/39, p. 542.

*Primary Examiner*—Henry J. Recla

*Attorney, Agent, or Firm*—Pahl, Lorusso & Loud

[57] ABSTRACT

This invention relates to a dual reusable filter respirator system. The respirator can be worn in dust, mist and fume environments for very long periods of time, while providing increased visibility, safety and comfort for the respirator wearer. A significant feature of the respirator is a pair of triangular shaped filter housings which allow the area of the filter media to be increased while at the same time reducing filter housing obstructions to the vision of the respirator wearer and creating a greater overall compactness of design.

6 Claims, 7 Drawing Figures

RESPIRATOR

CROSS REFERENCE TO A RELATED APPLICATION

This application is a continuation of U.S. patent application Ser. No. 493,664, filed 5/11/83 now abandoned, which is a continuation-in-part of U.S. patent application Ser. No. 439,930 filed Nov. 8, 1982, now abandoned, entitled "Improved Single-Element Filter and Respirator", the teachings of which are incorporated herein by reference.

BACKGROUND OF THE INVENTION

This invention relates to a respirator and dual disposable filter system with improved filtering capabilities, and improved wearer comfort, visibility and safety.

Standards set by the National Institute for Occupational Safety and Health (NIOSH) for lead fume environments, such as in welding operations, require that optimum breathing resistance be maintained over very long periods of time, generally five or more hours. Dust-mist protection standards set by NIOSH do not require long wear protection and can be easily satisfied with the respirator described in U.S. patent application Ser. No. 439,930. The respirator described in U.S. patent application Ser. No. 439,930 being designed for dust-mist protection, will not meet the standards set for lead fume environments. The respirator of the present invention also provides protection against other hazardous fumes including aluminum, antimony, cadmium, chromium, copper, iron, magnesium, manganese and zinc. The respirator of the present invention differs from the respirator of U.S. patent application Ser. No. 439,930 in that the respirator of the present invention contains two filter housings and filters whereas the respirator of U.S. patent application Ser. No. 439,930 has only one of these elements. The valve mechanisms of the respirator of the present invention are similar to those of the respirators of U.S. patent application Ser. No. 439,930.

When conventional respirators are used under a welding helmet or shield, the helmet facepiece contacts the filter housing to form an approximately 14° angle to the wearer's face. Thus, there is a relatively large gap at the chin where light and welding spatter can enter. Also the awkwardness of this angle is uncomfortable to the wearer because he must bend his body or head toward the work in order to see. This situation exists with the more conventional helmets. There are some welding helmets that are specifically designed for use with bulky breathing apparatuses. However, the cost of replacing conventional welding helmets with specially designed helmets may be extremely high.

SUMMARY OF THE INVENTION

The present invention provides a solution to several of the aforementioned problems of prior art respirators, such as inadequate filtering capability for long period of time, poor visibility and discomfort to the wearer. Specifically, the present invention relates to an improved, one-half facepiece, molded, reusable respirator, with two triangular-shaped filter housings with one positioned in each of opposed sides of the respirator facepiece. Each of said filter housings slope in at both sides toward the respirator facepiece. With this wrap-around, streamlined filter design, a conventional welding helmet or shield can drop to about a 7° angle with the face for welding. This lessens the chin gap and places the welding plate in a more comfortable position before the eyes and requires less bending of the head or body toward the work. The top of the respirator facepiece sits comfortably across the bridge of the nose, following the contours of the nose; and the bottom of the respirator facepiece sits between the mouth and chin, curving in from the cheeks to follow the facial curvature. A single exhalation valve is located on the front of the respirator facepiece between the two filter housings. Adjustable straps hold the respirator facepiece firmly onto the face. An increased filter element area and an improved filter media reduce the inhalation resistance. A new rubber compound used to manufacture the exhalation valve reduces the exhalation resistance, enabling the respirator to be worn in silica dust, silica mist, asbestos environments, lead and other hazardous fume environments. The respirator provides comfort to the respirator wearer and minimal obstruction of the wearer's vision even with the dual filter system. This is because of: (1) the particular location and geometry of the two filter elements (triangular-shaped and inwardly sloping); (2) the structure, positioning and size of the respirator facepiece; (3) the location and small size of the exhalation valve; and (4) the positioning of the straps. This improved vision which results enables the wearer to function more effectively and more safely.

Accordingly, it is an object of the present invention to provide a respirator with dual replaceable single-element filters for greater filter surface area for improved effectiveness to silica dust, silica mist, asbestos, lead and other hazardous fume environments for long periods of time.

It is a further object of this invention to provide a one-half facepiece, molded, reusable respirator with a greater overall compactness of design, providing improved comfort, visibility and safety for the respirator wearer.

Other objects and further scope of applicability of the present invention will become apparent from the detailed description to follow, taken in conjunction with the accompanying drawings.

DESCRIPTION OF THE PREFERRED EMBODIMENTS

Figure 1:
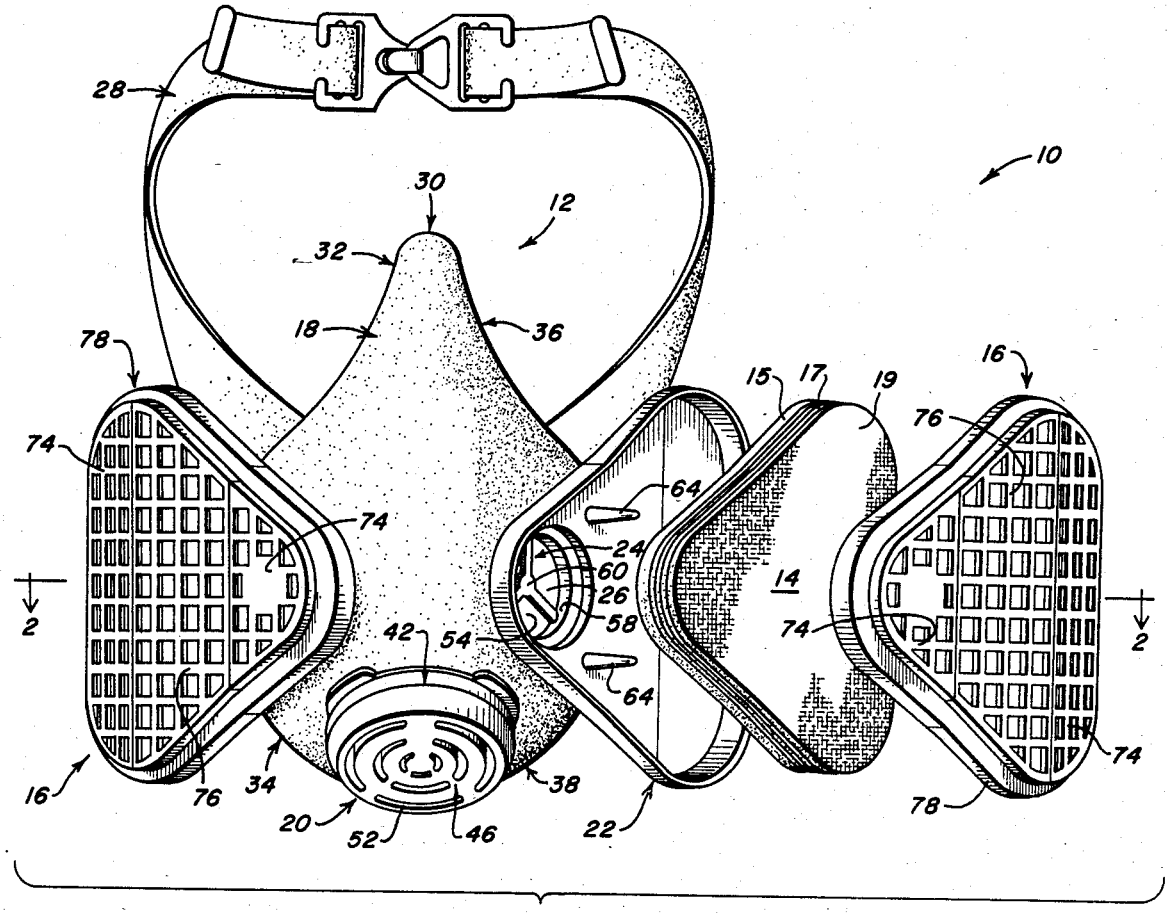
FIG. 1 is a front elevational view of the respirator showing the filter covers, a filter and facepiece with attached filter holders.
Figure 2:
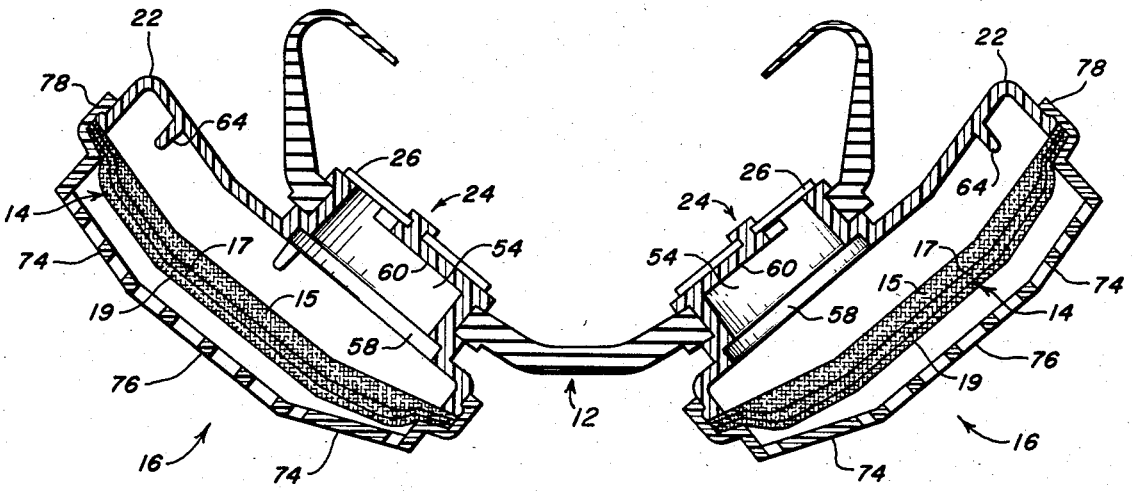
FIG. 2 is a cross-sectional view of the respirator taken along line 2—2 of FIG. 1.
Figure 3:
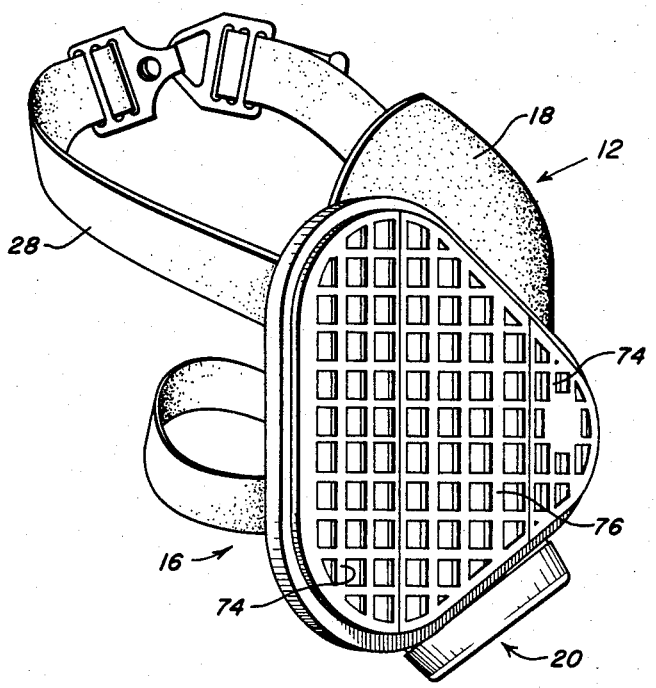
FIG. 3 is a side view of the respirator.

The respirator 10 of this invention has five main separable pieces; the facepiece, two filters and two filter covers. The facepiece 12, as illustrated in FIGS. 1–3 and 5–7, contains a facepiece body 18, an exhalation valve 20, two filter holders or housings 22 each with a contained inhalation valve 24 and inhalation valve flap 26, and an elastic band 28.

The facepiece body 18 is made of a firm, flexible, molded material such as rubber and fits firmly and comfortably on the wearer's face. An upper portion 30 of the facepiece body 18 is formed with an inwardly folding ridge 32 which conforms to the bridge of the wearer's nose. This inward folding ridge 32 extends around the inner perimeter of the facepiece body 18 in order to provide a good air seal during inhalation and exhalation so that air will pass only through the two respirator inhalation valves 24 and the single exhalation valve 20, thus providing effective filtering. This ridge 32 provides a flexible, non-irritating surface which conforms comfortably to the wearer's face.

An outer ridge 34 of the facepiece body 18 interior extends outwardly away from the inward folding ridge 32 around the perimeter of the facepiece body 18 where it is in contact with the wearer's face. This outer ridge 34 becomes wider in the region where the facepiece body 18 covers the wearer s cheeks, causing a material stiffness which maintains the respirator's shape over this region while providing a second air seal. The outer ridge 34 is rounded to provide a non-irritating, good contact with the wearer's face.

Side sections 36 of the facepiece body 18 are indented to fit along either side of the nose bridge just above the nostrils to give a snug fit. A lower portion 38 of the facepiece body 18 is contoured to fit immediately above the wearer's chin. The facepiece body 18 is cupped outwardly to keep it away from the wearer's nostrils and mouth, yet not so far as to cause visual obstruction. The facepiece body is similar in configuration to the one-quarter facepiece body of the respirator described in U.S. patent application Ser. No. 439,930.

A single exhalation valve mechanism 20 is situated through a circular hole in the facepiece body 18 in front of the wearer's mouth. The inner circumference of the rubber defining the circular hole is flanged out, forming an extended collar 40 in the facepiece body 18 to stabilize the exhalation valve mechanism 20.

Figure 4:
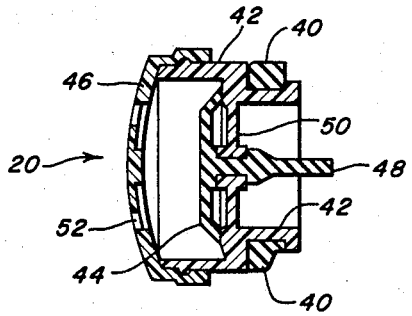
FIG. 4 is a cross-sectional plan view of the exhalation valve mechanism of the respirator.
Figure 5:
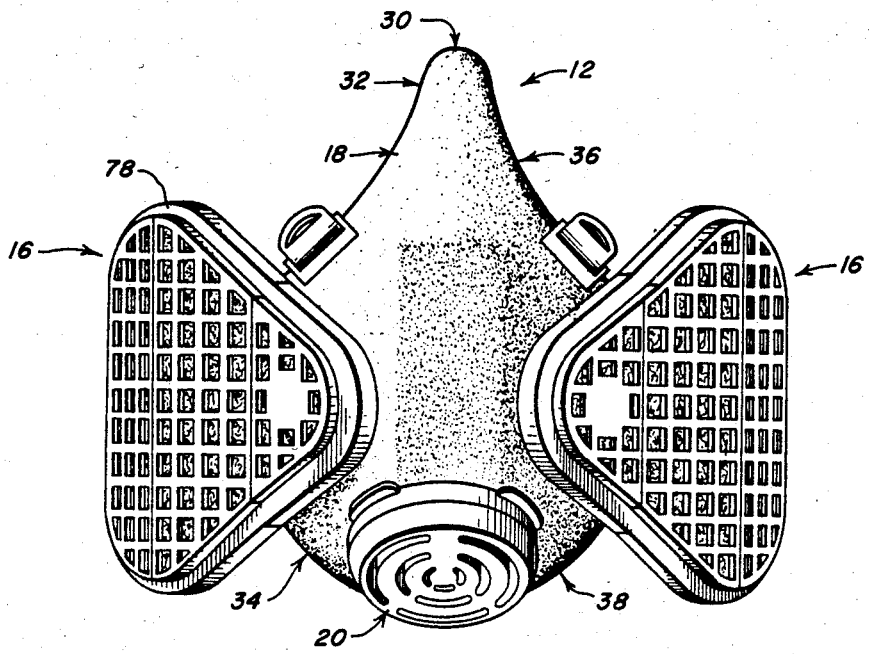
FIG. 5 is a front elevational view of the respfrator.
Figure 6:
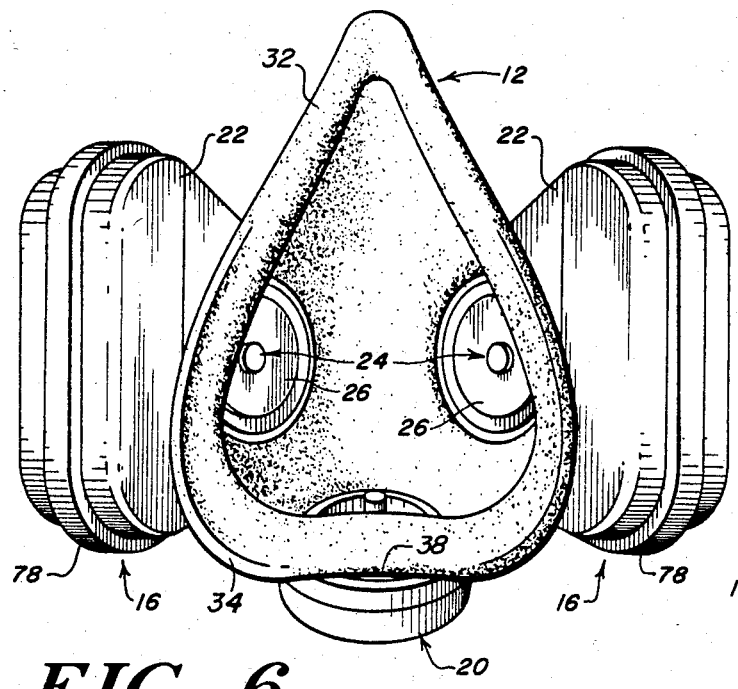
FIG. 6 illustrates the respirator in rear perspective.
Figure 7:
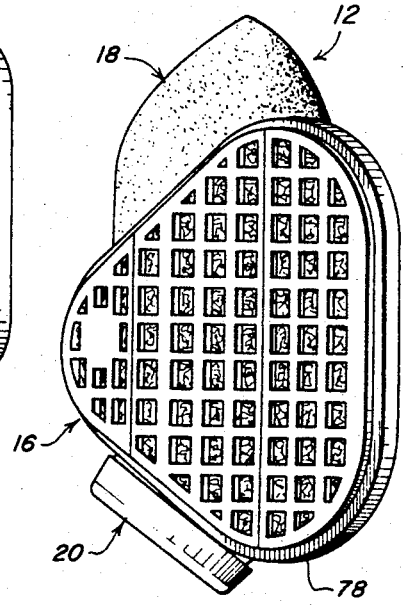
FIG. 7 is a view of one side of the respirator, the opposite side being of substantially the same appearance.

As is best shown in FIG. 4, the exhalation valve mechanism 20 consists essentially of a rigid, molded plastic, cylindrical valve seat 42 upon which a flexible valve flap 44 is seated, and a semi-rigid, molded plastic, protective, perforated valve cover 46. The valve flap 44 is seated during inhalation, and because of its flexible properties, it opens by flexing outward when the wearer exhales. A suitable rubber for forming the valve flap 44 is identified as compound #R-47529 by Acushnet Company, New Bedford, Mass. A valve flap stem 48, which is the end section of the valve flap 44, is held in position by a rigid plastic ring-and-spoke system 50, allowing free movement of exhaled breath to act upon the valve flap 44. The valve flap 44, made of a flexible material, such as rubber, is protected from external damage and dirt by a valve cover 46 which is perforated by an array of holes 52 to allow free passage of exhaled breath.

Two inhalation valve mechanisms 24 are positioned through circular holes in the facepiece body in opposing positions on either side of the wearer's mouth. By placing the holes adjacent triangular filter housings (as opposed to centrally as is done in many prior art devices) as shown, the housings can be situated to the side of the wearer's face enabling better viewing. The inner circumference of these holes is flanged out to form an extended collar in the facepiece body to stabilize the inhalation valve mechanism.

These inhalation valve mechanisms 24 are identical in construction. Each inhalation valve mechanism 24 consists essentially of a rigid, molded plastic, cylindrical valve seat 58 upon which a flexible valve flap 26 is seated; and a spoke-and-button system 60 which anchors the valve flap 26. The inhalation valve flap 26, made of a thin flexible material such as rubber, is seated during exhalation and is flexed open during inhalation toward the wearer's nostrils.

This valve flap 26 is fastened to a cylindrical button in the center of the spoke-and-button system through a small cylindrical hole in the inhalation valve flap 26, allowing free movement of inhaled, filtered air. The intake of the inhalation valve mechanism 24 extends outward from the facepiece body 18 to become a contained part with the back of the filter holder 22. Three posts 64 extending from the filter holder 22 hold a felt filter 14 in place within the filter housing element. Pins or posts 64 prevent sagging of the filter element against the rear wall of the housing 22. Without the support provided by the pins 64, increased breathing resistance would be produced by a lack of free space over and around the hole 54 of each inhalation valve. Many prior art respirators have designs which do not prevent sagging of filter components against or toward inhalation valves.

In order to hold the respirator 10 onto the wearer's face, an adjustable elastic band 28 loops from the facepiece body 18 to around the wearer's head and upper neck. The elastic band 28 passes through a D-shaped hole in the end of a metal clip on each side of the facepiece body, allowing band movement, and thus adjustment. The opposite end of each metal clip is embedded within a slot, located in an outward-extended tab of the facepiece body 18.

The filters 14 are triangular in shape and approximately 1½ cm thick. Each comprises an approximately 5 mm thick layer of low breathing resistance felt material 15 as supplied by American Felt and Filter, an intermediate approximately 8 mm thickness of loosely randomly arranged glass fibers 17 and a fume diffusing outermost pad 19, e.g., of non-woven polyester fibers. The filter elements 14 are positioned within housing 22 with respective layers of felt 15 directed toward posts 64. The opposite outermost pads 19 thereby diffuse fumes entering elements 14 and prevent excessive loading (clogging) of glass fibers 17. These filters 14 have a larger area than conventional single element filters, and are thus effective in silica dust, silica mist, asbestos and lead-fume environments. The use of the dual filter unit makes it possible for the wearer to be safely exposed to lead fume environments for periods of five or more hours.

Triangular-shaped filter covers 16 snap onto each of the filter holders 22 to contain and protect the filter 14, while allowing air for breathing to flow into the respirator 10. Both sides of each filter cover screen 74 are canted or slanted backward away from the plane of the center of the filter cover screen 76 toward the respirator facepiece 12 or wearer. Each enclosed filter 14, each filter cover rim 78 and the lower portion of each of the filter holders 22 also maintain this backward cant, producing a wraparound shape for the entire filter housing element, and thus providing improved visibility, safety and comfort for the respirator wearer.

Although the invention has been described with reference to these preferred embodiments, other embodiments can achieve the same results. Variations and modifications of the present invention will be obvious to those skilled in the art and it is intended to cover in the appended claims all such modifications and equivalents.

We claim:

1. A respirator comprising:

a facepiece made of flexible material;

an exhalation valve positioned in front of said facepiece to allow air flow through the front of said facepiece;

a pair of inhalation valves with one inhalation valve being positioned in each opposed side of said facepiece to allow air flow through each opposed side of said facepiece;

said facepiece being designed so that it fits snugly to the contours of the wearer's face and only allows airflow through said valves when worn by a wearer;

a pair of triangular shaped filter housings being carried by said facepiece, each housing having a solid back defining an aperture in communication with each of said inhalation valves, said housing also having side walls around the perimeter of said solid back for containing a filter, when provided, within said walls; and a pair of triangular shaped filter covers, one of said covers covering each of said filter housings and filters, when provided, said covers each having a perforated face which allows air flow through said perforated faces into said apertures and on through said inhalation valves when the wearer inhales;

a first vertex of each triangular filter housing being oriented towards the center of the mask and towards the other first vertex so that said two vertices are the closest adjacent portions of said filter housings, each of said apertures also being positioned closer to said first vertex than to any other vertex of said triangular shaped filter housing, and wherein each perforated face of said filter covers comprises three connecting surfaces, said surfaces forming an approximate convex curved shape which slopes in towards the respirator facepiece to reduce obstructions to the vision of the respirator wearer.

2. The respirator as set forth in claim 1 further comprising a removable triangular shaped filter contained within said side walls of each of said filter housings.

3. The respirator as set forth in claim 2 also comprising filter support pins extending from each filter housing to the filter which provide free air space between the inhalation valve and the filter.

4. The respirator as set forth in claim 1 wherein said filters each comprise a first layer of felt material, an intermediate thickness of glass fibers and an outer fume diffusing fiber pad.

5. The respirator as set forth in claim 4 wherein said fume diffusing pad is formed of non-woven synthetic fibers.

6. The respirator as set forth in claim 4 wherein said filters in said housings are placed with said layer of felt directed toward said inhalation valves.

* * * * *